US011041397B1

(12) United States Patent
McCaffrey

(10) Patent No.: US 11,041,397 B1
(45) Date of Patent: Jun. 22, 2021

(54) NON-METALLIC SIDE PLATE SEAL ASSEMBLY FOR A GAS TURBINE ENGINE

(71) Applicant: United Technologies Corporation, Farmington, CT (US)

(72) Inventor: Michael G. McCaffrey, Windsor, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 6 days.

(21) Appl. No.: 16/713,284

(22) Filed: Dec. 13, 2019

(51) Int. Cl.
*F01D 5/30* (2006.01)
*F01D 11/00* (2006.01)

(52) U.S. Cl.
CPC ..... *F01D 11/001* (2013.01); *F01D 5/3015* (2013.01); *F05D 2240/55* (2013.01); *F05D 2240/80* (2013.01); *F05D 2260/36* (2013.01); *F05D 2300/6033* (2013.01)

(58) Field of Classification Search
None
See application file for complete search history.

(56) References Cited

U.S. PATENT DOCUMENTS 4,439,107 A 3/1984 Antonellis
5,811,900 A * 9/1998 Serdar, Jr. ..... B60L 50/13 310/74
9,605,552 B2 3/2017 Woodrasek et al.
10,408,087 B2 9/2019 Snyder et al.
10,428,661 B2 10/2019 Thomas et al.
2003/0201608 A1* 10/2003 Addis ..... F16J 15/3288 277/355
2008/0044284 A1* 2/2008 Alvanos ..... F01D 11/02 416/193 A
2008/0136112 A1* 6/2008 Addis ..... F16J 15/3288 277/355
2010/0226760 A1* 9/2010 McCaffrey ..... F01D 11/08 415/173.1
2013/0327854 A1* 12/2013 Davis, III ..... F01D 11/005 239/589
2016/0201498 A1* 7/2016 Farris ..... C23C 28/042 415/173.1
2017/0211404 A1* 7/2017 McCaffrey ..... F01D 11/08
2017/0268364 A1* 9/2017 McCaffrey ..... F01D 5/284
2017/0268370 A1* 9/2017 McCaffrey ..... F01D 11/08
2017/0362952 A1* 12/2017 Stoyanov ..... F01D 21/003
2019/0107003 A1* 4/2019 Sheedy ..... F01D 25/183

* cited by examiner

*Primary Examiner* — Michael Lebentritt
(74) *Attorney, Agent, or Firm* — Bachman & LaPointe, P.C.

(57) ABSTRACT

A side plate seal assembly for a gas turbine engine includes a multiple of non-metallic side plate seals that are arranged about an axis of the gas turbine engine to form a full hoop seal, each of the multiple of side plate seals comprise a retention surface and a knife edge seal surface that extends at an angle therefrom.

20 Claims, 5 Drawing Sheets

NON-METALLIC SIDE PLATE SEAL ASSEMBLY FOR A GAS TURBINE ENGINE

BACKGROUND

The present disclosure relates to a gas turbine engine and, more particularly, to a seal therefor.

Gas turbine engines typically include a compressor section to pressurize flow, a combustor section to burn a hydrocarbon fuel in the presence of the pressurized air, and a turbine section to extract energy from the resultant combustion gases. The combustion gases commonly exceed 2000 degrees F. (1093 degrees C.).

Cooling of engine components is performed via communication of cooling flow through airfoil cooling circuits. Gas path recirculation between static and rotating components may be caused by local, circumferential pressure variations. Bow waves from airfoil leading edges create higher static pressure locally in front of the airfoil and wakes that exit airfoils create local pressure and velocity gradients which interact with the down-stream airfoils. Due to limitations of blade platform overhangs, especially on high speed turbines, the circumferential pressure variation can extend past the flowpath edge, which may cause a cavity, defined as the space between a static and rotating body, to be exposed to cyclic pressure fluctuations. Such pressure fluctuations may cause hot gases to be pushed into the cavities, with potential detrimental effects such as excessive heating of the components.

To prevent or minimize the amount of hot gas ingestion, secondary cooling airflow system pressure may be increased to generate a net positive outflow. This increase in pressure may result in a significant loss in cycle efficiency. To minimize such cycle losses, the size of the cavity closest to the flowpath is minimized. Often this requires the rotating knife-edges of a turbine rotor to operate close to the flowpath, and a significant quantity of secondary cooling airflow to the knife edge seals and outer regions.

SUMMARY

A side plate seal assembly for a gas turbine engine according to one disclosed non-limiting embodiment of the present disclosure includes a multiple of non-metallic side plate seals that are arranged about an axis of the gas turbine engine to form a full hoop seal, each of the multiple of side plate seals comprise a retention surface and a knife edge seal surface that extends at an angle therefrom.

A further embodiment of any of the foregoing embodiments of the present disclosure includes that the multiple of non-metallic side plate seals that are arranged about the axis each interface one to another via a shiplap interface.

A further embodiment of any of the foregoing embodiments of the present disclosure includes that the multiple of non-metallic side plate seals are manufactured of a ceramic matrix composite (CMC).

A further embodiment of any of the foregoing embodiments of the present disclosure includes that the multiple of non-metallic side plate seals are manufactured of an organic matrix composite (OMC).

A further embodiment of any of the foregoing embodiments of the present disclosure includes that the knife edge seal surface extends from the retention surface at the angle between 130-160 degrees.

A further embodiment of any of the foregoing embodiments of the present disclosure includes that the retention surface is generally planar.

A further embodiment of any of the foregoing embodiments of the present disclosure includes that the retention surface tapers to an inner diameter surface.

A rotor assembly for a gas turbine engine according to one disclosed non-limiting embodiment of the present disclosure includes a rotor disk that defines an axis; a full hoop cover plate; and a non-metallic side plate seal assembly at least partially between the rotor disk and the full hoop cover plate, the non-metallic side plate seal assembly comprises a multiple of non-metallic side plate seals that are arranged about the axis.

A further embodiment of any of the foregoing embodiments of the present disclosure includes that the rotor disk and full hoop cover plate are manufactured of a metallic alloy.

A further embodiment of any of the foregoing embodiments of the present disclosure includes that the multiple of non-metallic side plate seals each interface one to another via a shiplap interface.

A further embodiment of any of the foregoing embodiments of the present disclosure includes that the full hoop cover plate forms at least one knife edge seal and the non-metallic side plate seal assembly forms at least one knife edge seal, the non-metallic side plate knife edge seal outboard of the full hoop cover plate knife edge seal with respect to the axis.

A further embodiment of any of the foregoing embodiments of the present disclosure includes that an outer diameter edge of a retention surface of the non-metallic side plate seal assembly abuts a platform of a rotor blade retained in the disk.

A further embodiment of any of the foregoing embodiments of the present disclosure includes that the non-metallic side plate knife edge seal interfaces with a seal surface attached an inner vane platform, the inner vane platform downstream of the rotor disk.

A further embodiment of any of the foregoing embodiments of the present disclosure includes that a lower surface that includes an inner diameter edge of the retention surface is sandwiched between the rotor disk and the full hoop cover plate.

A further embodiment of any of the foregoing embodiments of the present disclosure includes that each of the multiple of non-metallic side plate seals are identical.

A gas turbine engine according to one disclosed non-limiting embodiment of the present disclosure includes a rotor disk along an engine axis; an inner vane platform adjacent to the rotor disk; a seal surface attached an inner vane platform; and a non-metallic side plate seal assembly, the non-metallic side plate seal assembly comprises a retention surface adjacent to the rotor disk and a knife edge seal surface that extends at an angle from the retention surface to interface with the seal surface.

A further embodiment of any of the foregoing embodiments of the present disclosure includes that the non-metallic side plate seal assembly comprises a multiple of non-metallic side plate seals that are identical.

A further embodiment of any of the foregoing embodiments of the present disclosure includes that the multiple of non-metallic side plate seals each interface one to another via a shiplap interface.

A further embodiment of any of the foregoing embodiments of the present disclosure includes that an outer diameter edge of a retention surface of the non-metallic side plate seal assembly abuts a platform of a rotor blade retained in the disk.

A further embodiment of any of the foregoing embodiments of the present disclosure includes that a lower surface that includes an inner diameter edge of the retention surface is sandwiched between the rotor disk and a full hoop cover plate, wherein the full hoop cover plate forms at least one knife edge seal inboard of non-metallic side plate knife edge seal with respect to the engine axis.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
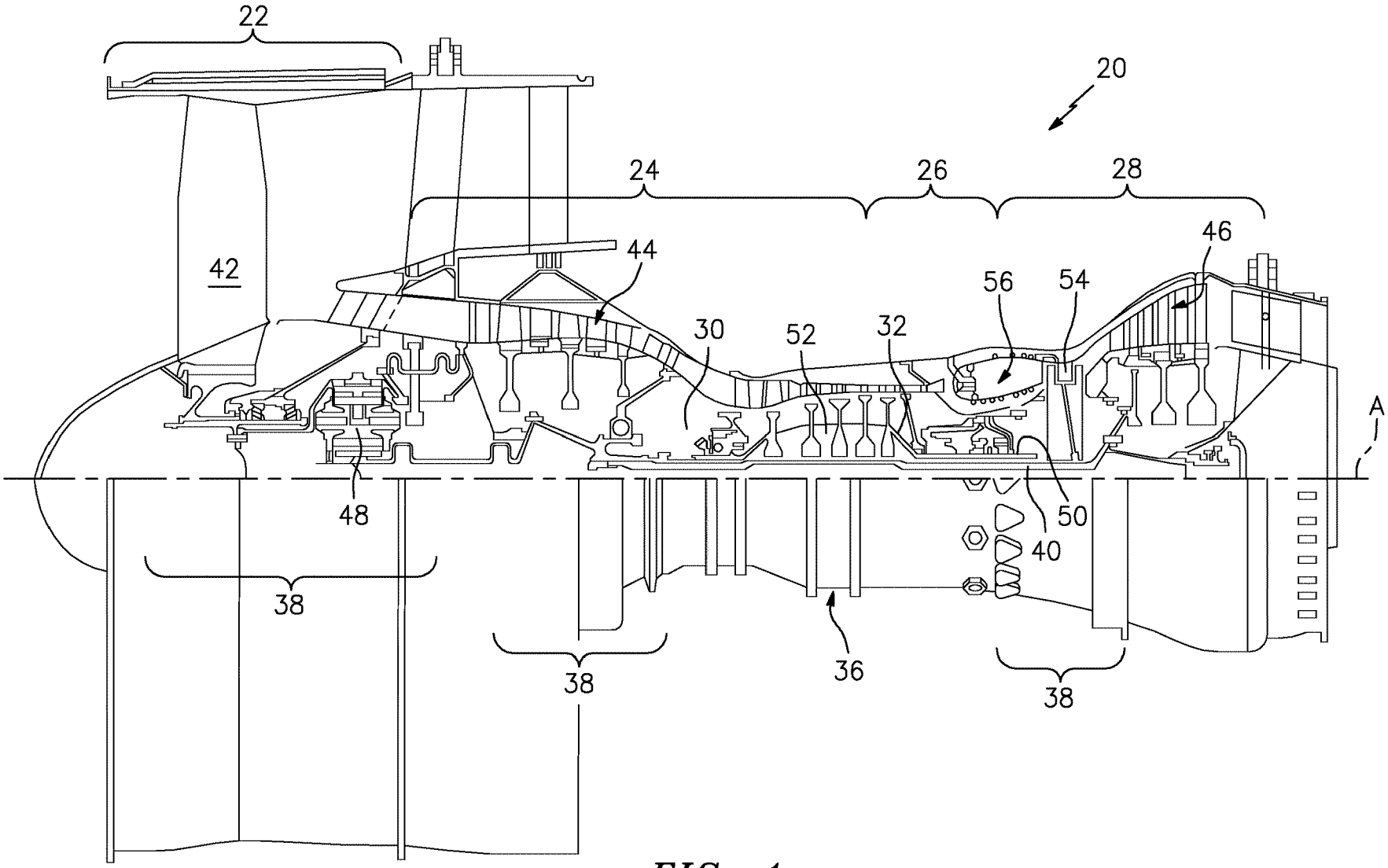
FIG. 1 is a schematic cross-section of an example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, the concepts described herein may be applied to other turbine engine architectures such as turbojets, turboshafts, and three-spool (plus fan) turbofans.

The engine 20 generally includes a low spool 30 and a high spool 32 mounted for rotation about an engine central longitudinal axis A relative to an engine case structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core flow is compressed by the LPC 44 then the HPC 52, mixed with the fuel and burned in the combustor 56, then the combustion gasses are expanded over the HPT 54 and the LPT 46. The turbines 46, 54 rotationally drive the respective low spool 30 and high spool 32 in response to the expansion. The main engine shafts 40, 50 are supported at a plurality of points by bearing assemblies 38 within the engine case structure 36.

Figure 2:
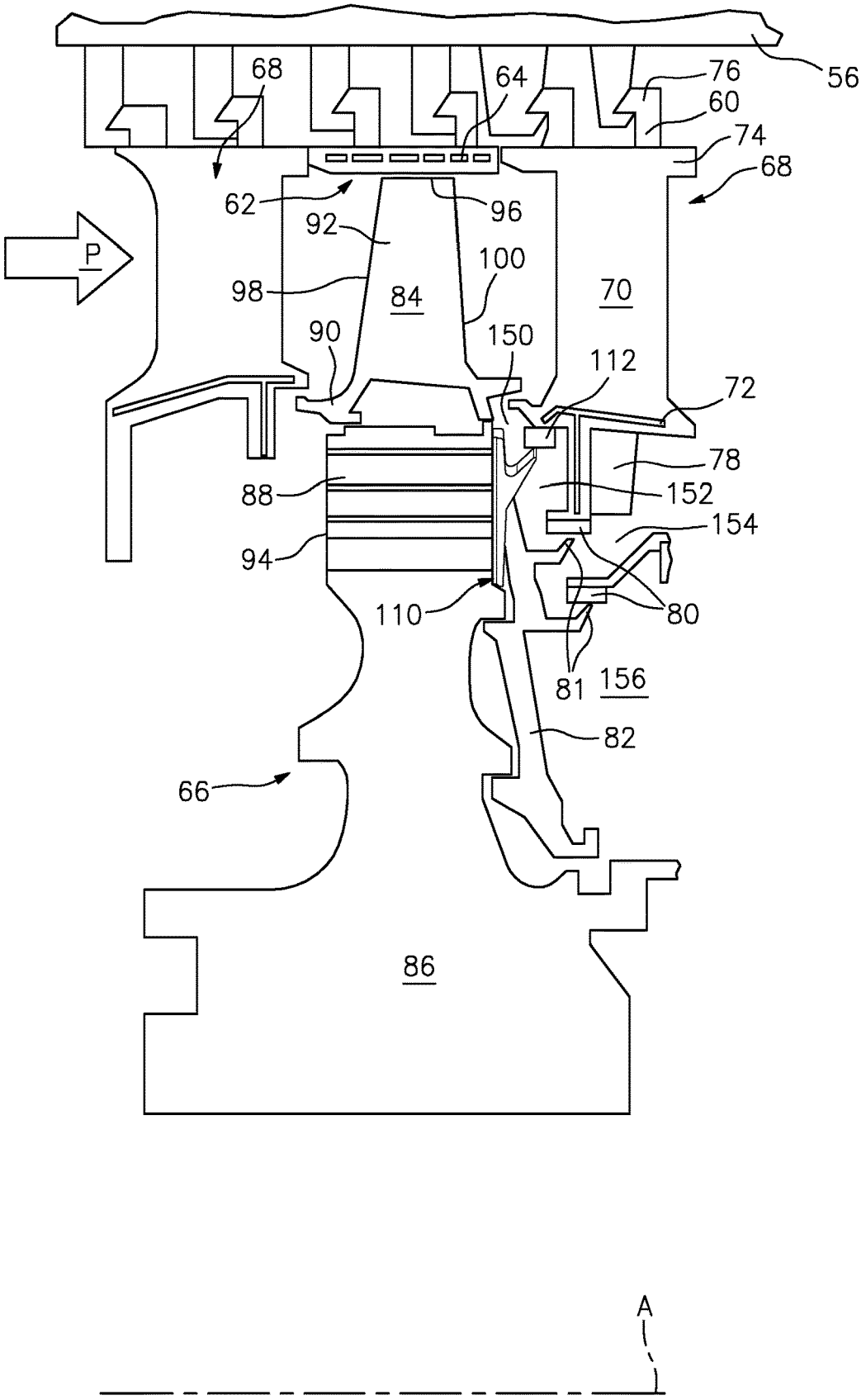
FIG. 2 is an schematic cross-section of an engine turbine section including a side plate seal assembly.

With reference to FIG. 2, an enlarged schematic view of a portion of the turbine section 28 is shown by way of example. A full ring shroud assembly 60 within the engine case structure 36 supports a blade outer air seal (BOAS) assembly 62. The blade outer air seal (BOAS) assembly 62 contains a multiple of circumferentially distributed BOAS 64 proximate to a rotor assembly 66. The full ring shroud assembly 60 and the blade outer air seal (BOAS) assembly 62 are axially disposed adjacent to a stationary vane ring 68. The vane ring 68 includes an array of vanes 70 between a respective inner vane platform 72 and an outer vane platform 74. The stationary vane ring 68 may be mounted to the engine case structure 36 by a multiple of segmented hooked rails 76 that extend from the outer vane platform 74. The vane rings 68 align the flow while the rotor assembly 66 collects the energy of the working medium combustion gas flow to drive the turbine section 28 which in turn drives the compressor section 24. One rotor assembly 66 and one downstream stationary vane ring 68 are described in detail as representative of any number of multiple engine stages.

The rotor assembly 66 includes an array of blades 84 circumferentially disposed around a disk 86. While the description below refers to "blades" in the turbine section, the seal configurations are applicable to both buckets and blades in the respective turbine and compressor sections of turbomachines. It will be appreciated that the term "bucket" usually refers to the airfoil-shaped components employed in the turbine section(s) of turbomachines, while the term "blade" usually refers to the airfoil-shaped components typically employed in the compressor section of the machines.

Each blade 84 includes a root 88, a platform 90 and an airfoil 92. The blade roots 88 are received within a respective slot 94 in the disk 86 and the airfoils 92 extend radially outward such that a tip 96 of each airfoil 92 is closest to the blade outer air seal (BOAS) assembly 62. The airfoil 92 defines a blade chord between a leading edge 98, which may include various forward and/or aft sweep configurations, and a trailing edge 100. A first sidewall that may be convex to define a suction side, and a second sidewall that may be concave to define a pressure side are joined at the leading edge 98 and at the axially spaced trailing edge 100. The tip 96 extends between the sidewalls opposite the platform 90.

The blade outer air seal (BOAS) assembly 62, the platform 90, the inner vane platform 72 and the outer vane platform 74 define the working medium combustion gas flow in a primary flow path P. The blade outer air seal (BOAS) assembly 62 and the outer vane platform 74 define an outer boundary of the flow path P. The platform 90 and the inner vane platform 72 bound the inner portion of the flow path P.

A full hoop inner air seal 78 that extends from the inner vane platform 72 provides one or more seal surfaces 80 that seal with the rotor assembly 66 to further contain the inner portion of the flow path P. The rotor assembly 66 includes a full hoop cover plate 82 with respective knife edges 81 that interface with the seal surfaces 80. The full hoop cover plate 82 may be manufactured of alloys such as Inconel 625, Inconel 718 and Haynes 230 which have specific benefit for high temperature environments, such as, for example, environments typically encountered by aerospace and gas turbine engine.

A side plate seal assembly 110 also interfaces with a seal surface 112 that attaches to, or extends from, the inner vane platform 72. The seal surfaces 80, 112 may be manufactured of a honeycomb material in which the honeycombs of these honeycomb structures may be open in the direction toward the knife edge seal projections.

Figure 3:
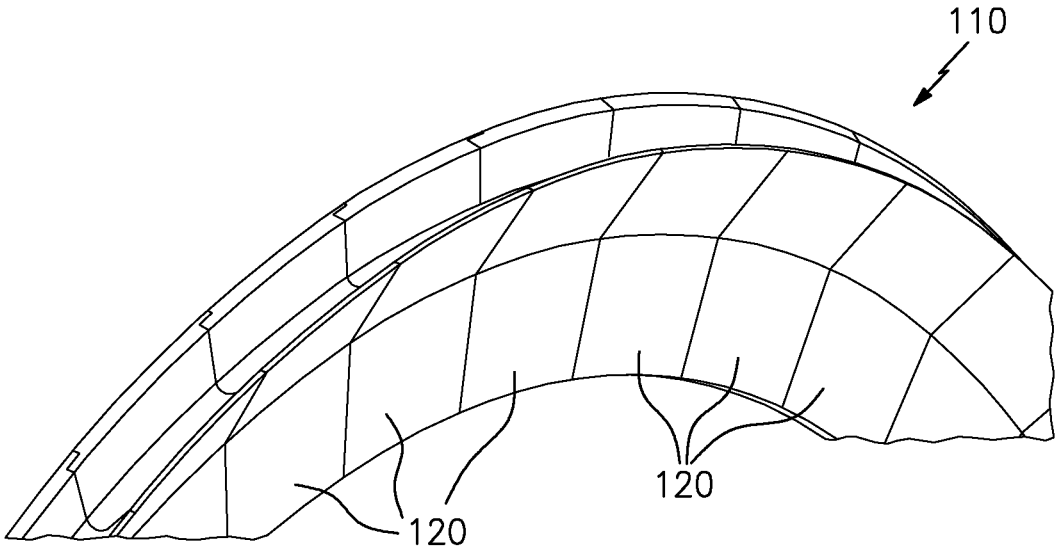
FIG. 3 is a partial perspective view of the side plate seal assembly.

The side plate seal assembly 110 is formed from a multiple of side plate seal segments 120 (FIG. 3) that are manufactured of a non-metallic material such as ceramic matrix composite (CMC) or organic matrix composite (OMC). The ceramic matrix composite (CMC) or organic matrix composite (OMC) material typically includes prepreg ceramic plys that include prepreg ceramic fiber tows, the tows in each ply lying adjacent to one another in a planar arrangement such that each ply has a unidirectional orientation. Examples of CMC materials include, but are not limited to, carbon-fiber-reinforced carbon (C/C), carbon-fiber-reinforced silicon carbide (C/SiC), silicon-carbide-fiber-reinforced silicon carbide (SiC/SiC), alumina-fiber-reinforced alumina ($Al_2O_3/Al_2O_3$), organic matrix composite (e.g. carbon fiber epoxy) or combinations thereof. The CMC may have increased elongation, fracture toughness, thermal shock, dynamic load capability, and anisotropic properties as compared to a monolithic ceramic structure. Other Ceramic matrix composite (CMC) materials may utilize tackified ceramic fabric/fibers whereby the fibers have not been infiltrated with matrix material, 3D weave architectures of dry fabrics, and others. Although CMCs are primarily discussed in the disclosed embodiment, other such non-metallic materials may also be utilized to form the segments.

Manufacture of the CMC typically includes laying up pre-impregnated composite fibers having a matrix material already present (prepreg) to form the geometry of the part (pre-form), autoclaving and burning out the pre-form, infiltrating the burned-out pre-form with the melting matrix material, then final machining and treatments of the pre-form. Infiltrating the pre-form may include depositing the ceramic matrix out of a gas mixture, pyrolyzing a pre-ceramic polymer, chemically reacting elements, sintering, generally in the temperature range of 1700-3000 F (925-1650 C), or electrophoretically depositing a ceramic powder.

Figure 4:
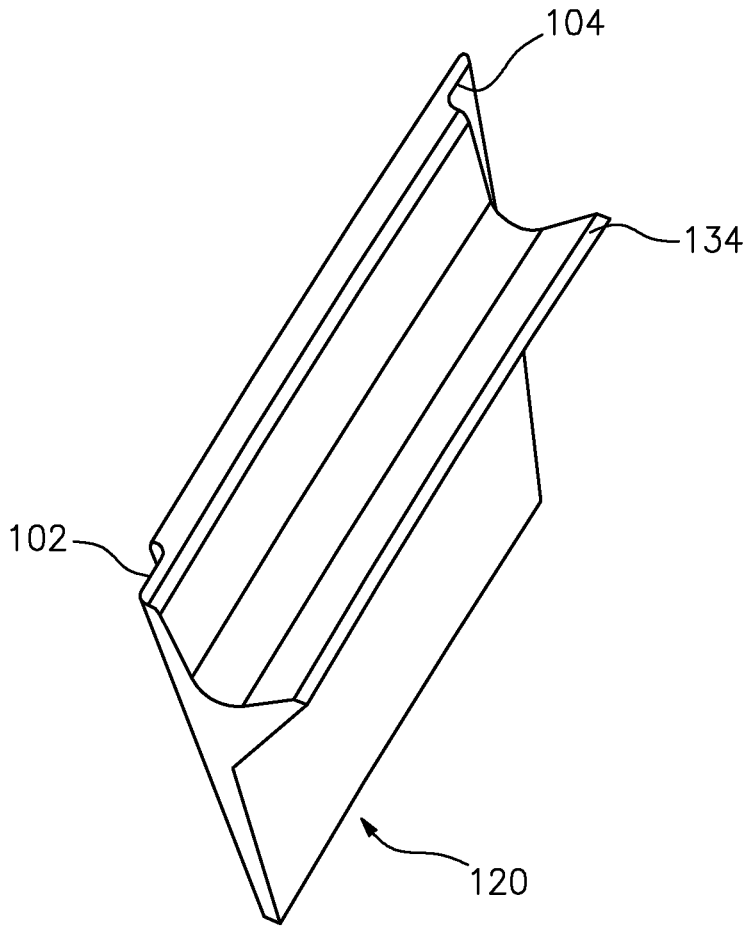
FIG. 4 is a partial perspective view of the side plate seal assembly illustrating the segments thereof.

Each of the multiple of side plate seal segments 120 include a shiplap interface 102, 104 (FIG. 4) to form the full ring side plate seal assembly 110 that is retained between the full hoop cover plate 82 and the disk 86. The multiple of side plate seal segments 120 may be identical segments to facilitate manufacture as well as accommodate thermal growth of the adjacent alloy full hoop cover plate 82 and disk 86.

Figure 5:
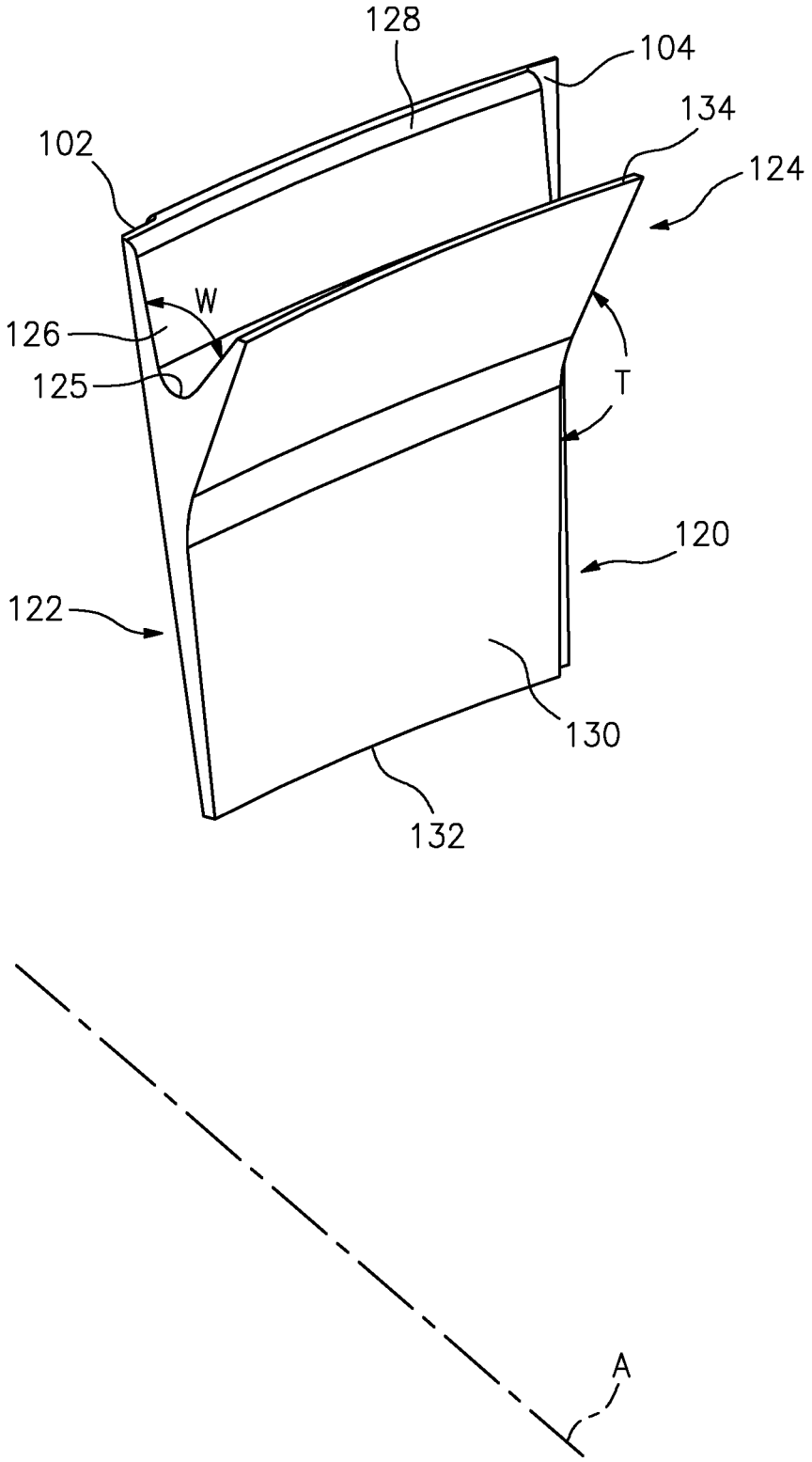
FIG. 5 is a perspective view of one segment of the side plate seal assembly.

Each of the multiple of side plate seal segments 120 includes a retention surface 122 and a knife edge seal surface 124 that extends at an angle T thereto. The retention surface 122 is generally planar. The knife edge seal surface 124 extends from the retention surface 122 with a significant radius 125 to facilitate manufacture. An upper surface 126 that includes an outer diameter edge 128 of the retention surface 122 forms an angle W with the knife edge seal surface 124. In one example, the angle T may be from 130-160 degrees and more specifically 145 degrees, and the angle W may be from 30-60 degrees and more specifically 43 degrees (FIG. 5). A lower surface 130 that includes an inner diameter edge 132 of the retention surface 122 provides an inner axial constraint surface. In one embodiment, the lower surface 130 tapers to the inner diameter edge 132 of the retention surface 122 to further reduce centrifugal load on the full ring side plate seal assembly 110 during engine operation.

The retention surface 122 formed by the multiple of side plate seal segments 120 forms a full hoop plate that when assembled around the axis A, is retained between the full hoop cover plate 82 and the disk 86. The outer diameter edge 128 of the retention surface 122 may also abut the platform 90 to further retain the side plate seal assembly 110 against the centrifugal loads during engine operation. That is, the side plate seal assembly 110 is retained under the platforms 90 formed by the adjacent blades 84 during engine operation.

The knife edge seal surface 124 formed by the multiple of side plate seal segments 120 forms an annular array of knife edge seal edge 134 that rides along the seal surface 112. The knife edge seal surface 124 extends from the retention surface 122 and may thereby replace the outer most seal region of the rotating full hoop cover plate 82. The non-metallic side plate seal assembly 110 is capable of withstanding the hot gas recirculation and pumping with minimal secondary flow and thereby further protects the metallic full hoop cover plate 82. Replacing the outermost region of the full hoop cover plate 82 greatly reduces the thermal load and temperature of the full hoop cover plate 82, allowing a lighter and more durable full hoop cover plate 82.

The segmented side plate seal assembly 110 permits a relatively smaller outer cavity 150 (FIG. 2) that is operable at much higher temperatures as compared to inner cavities 152, 154, 156 without increased cooling airflow. The relatively smaller outer cavity 150 is the first impediment to hot gas ingestion and essentially shields the inboard static and rotating structures from high temperature core airflow. The low density of the CMC side plate seal assembly 110 greatly reduces the centrifugal load on the rotor assembly 66 compared to a cast metal alloy design. The ability of CMC structures to be woven with 2D and 3D enables the compressive load, applied at the outer edge, to be carried with low risk of delamination. The density and fiber architecture enables a relatively long projecting knife edge seal surface 124 from the side-plate, which maximizes the ability to seal over large axial translation of the rotor relative to the static structure, insuring a stable seal interface The knife edge seal surface 124 can resist 2200-2500F exposure mainly due to the inherent capability of SiC—SiC combined with the very low stress state in the knife edge seal surface 124. The ship-lap interfaces are readily manufactured by conventional grinding techniques. When combined with the relatively low coefficient of thermal expansion, the intersegment gaps between each segment can be minimized, because the risk of binding due to rapid heating relative to the rotor disk is avoided.

Although particular step sequences are shown, described, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason, the appended claims should be studied to determine true scope and content.

What is claimed is:

1. A side plate seal assembly for a gas turbine engine, comprising:

a multiple of non-metallic side plate seals that are arranged about an axis of the gas turbine engine to form a full hoop seal, each of the multiple of side plate seals comprise a retention surface and a knife edge seal surface that extends at an angle therefrom.

2. The side plate seal assembly as recited in claim 1, wherein the multiple of non-metallic side plate seals that are arranged about the axis each interface one to another via a shiplap interface.

3. The side plate seal assembly as recited in claim 1, wherein the multiple of non-metallic side plate seals are manufactured of a ceramic matrix composite (CMC).

4. The side plate seal assembly as recited in claim 1, wherein the multiple of non-metallic side plate seals are manufactured of an organic matrix composite (OMC).

5. The side plate seal assembly as recited in claim 1, wherein the knife edge seal surface extends from the retention surface at the angle between 130-160 degrees.

6. The side plate seal assembly as recited in claim 1, wherein the retention surface is generally planar.

7. The side plate seal assembly as recited in claim 1, wherein the retention surface tapers to an inner diameter surface.

8. A rotor assembly for a gas turbine engine, comprising:

a rotor disk that defines an axis;

a full hoop cover plate; and a non-metallic side plate seal assembly at least partially between the rotor disk and the full hoop cover plate, the non-metallic side plate seal assembly comprises a multiple of non-metallic side plate seals that are arranged about the axis.

9. The assembly as recited in claim 8, wherein the rotor disk and full hoop cover plate are manufactured of a metallic alloy.

10. The assembly as recited in claim 8, wherein the multiple of non-metallic side plate seals each interface one to another via a shiplap interface.

11. The assembly as recited in claim 8, wherein the full hoop cover plate forms at least one knife edge seal and the non-metallic side plate seal assembly forms at least one knife edge seal, the non-metallic side plate knife edge seal outboard of the full hoop cover plate knife edge seal with respect to the axis.

12. The assembly as recited in claim 8, wherein an outer diameter edge of a retention surface of the non-metallic side plate seal assembly abuts a platform of a rotor blade retained in the disk.

13. The assembly as recited in claim 12, wherein the non-metallic side plate knife edge seal interfaces with a seal surface attached an inner vane platform, the inner vane platform downstream of the rotor disk.

14. The assembly as recited in claim 12, wherein a lower surface that includes an inner diameter edge of the retention surface is sandwiched between the rotor disk and the full hoop cover plate.

15. The assembly as recited in claim 8, wherein each of the multiple of non-metallic side plate seals are identical.

16. A gas turbine engine, comprising:

a rotor disk along an engine axis;

an inner vane platform adjacent to the rotor disk;

a seal surface attached an inner vane platform; and a non-metallic side plate seal assembly, the non-metallic side plate seal assembly comprises a retention surface adjacent to the rotor disk and a knife edge seal surface that extends at an angle from the retention surface to interface with the seal surface.

17. The gas turbine engine as recited in claim 16, wherein the non-metallic side plate seal assembly comprises a multiple of non-metallic side plate seals that are identical.

18. The gas turbine engine as recited in claim 17, wherein the multiple of non-metallic side plate seals each interface one to another via a shiplap interface.

19. The gas turbine engine as recited in claim 18, wherein an outer diameter edge of a retention surface of the non-metallic side plate seal assembly abuts a platform of a rotor blade retained in the disk.

20. The gas turbine engine as recited in claim 19, wherein a lower surface that includes an inner diameter edge of the retention surface is sandwiched between the rotor disk and a full hoop cover plate, wherein the full hoop cover plate forms at least one knife edge seal inboard of non-metallic side plate knife edge seal with respect to the engine axis.

* * * * *